United States Patent [19]

Cheng

[11] 4,231,517

[45] * Nov. 4, 1980

[54] TRACK SECTION FOR MODEL VEHICLES

[76] Inventor: Richard C. M. Cheng, Suite 1604, Austin Center, Austin Ave., Kowloon, Hong Kong

[ * ] Notice: The portion of the term of this patent subsequent to Apr. 18, 1995, has been disclaimed.

[21] Appl. No.: 857,503

[22] Filed: Dec. 5, 1977

Related U.S. Application Data

[63] Continuation-in-part of Ser. No. 717,581, Aug. 25, 1976, Pat. No. 4,084,746.

[51] Int. Cl.[2] ..... A63H 18/02; A63H 18/12

[52] U.S. Cl. ..... 238/10 F; 191/22 C

[58] Field of Search ..... 238/10 R, 10 A, 10 B, 238/10 C, 10 E, 10 F; 104/53, 60, 147 A, 149; 46/1 K, 216, 257; 191/22 C; 273/86 R, 86 B

[56] References Cited

U.S. PATENT DOCUMENTS

| | | | |
|---|---|---|---|
| 3,206,122 | 9/1965 | Frisbie et al. | 238/10 F |
| 3,395,861 | 8/1968 | Kindred | 238/10 F |
| 3,729,133 | 4/1973 | Covert | 238/10 E |
| 4,066,211 | 1/1978 | Mak | 238/10 F |
| 4,081,133 | 3/1978 | Tong | 46/1 K |
| 4,084,746 | 4/1978 | Cheng | 238/10 F |

FOREIGN PATENT DOCUMENTS

| | | | |
|---|---|---|---|
| 1256125 | 12/1967 | Fed. Rep. of Germany | 238/10 F |
| 592855 | 5/1959 | Italy | 191/22 C |

*Primary Examiner*—Randolph A. Reese
*Attorney, Agent, or Firm*—Robert K. Youtie

[57] ABSTRACT

A model track section including a bed or plate and a plurality of end projections on each end arranged so that the end projections of one section enter into the spaces between end projections of a like section with the sections in end to end aligned relation, the upper bed section having open ended slots which open into the recesses between projections, and conductive strips or rails in the slots and projecting therefrom into the recesses between projections for wiping engagement with conductive strips of a like track section upon entering into end to end aligned relation.

2 Claims, 4 Drawing Figures

FIG. 3
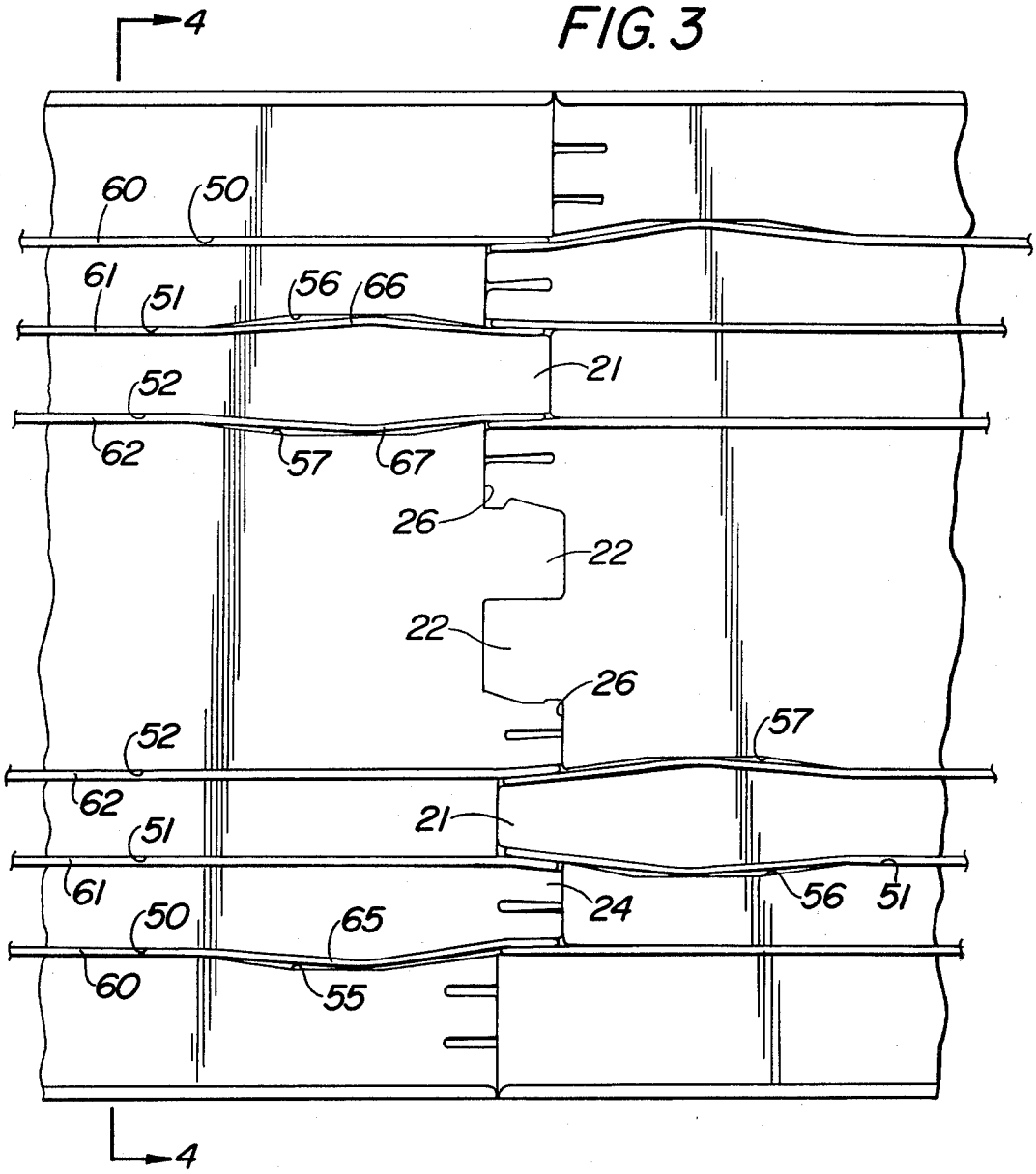
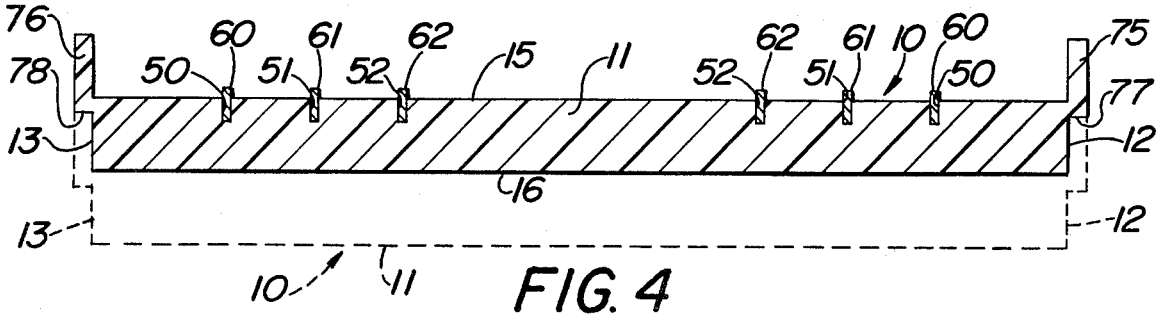
FIG. 4

TRACK SECTION FOR MODEL VEHICLES

CROSS-REFERENCES TO RELATED APPLICATIONS

This application is a continuation-in-part of my co-pending patent application Ser. No. 717,581, filed Aug. 25, 1976 entitled Model Track Section, now U.S. Pat. No. 4,084,746.

BACKGROUND OF THE INVENTION

While this invention is similar to the invention of said co-pending patent application in greatly facilitating the assembly and disassembly with like track sections, and in effecting economies in manufacture, the previously pending patent application was concerned with slot-type track for slot-type racing cars, and was incapable of use with slotless type model cars.

SUMMARY OF THE INVENTION

Accordingly, it is an important object of the present invention to provide a model track section for model racing vehicles of the slotless type, and wherein such vehicles may be capable of lane changing and passing, and further which is extremely simple to assemble and disassemble of like track sections by mere endwise aligned movement toward and away from each other, and permits of effecting substantial economies in manufacture and fabrication.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 3 is a plan view showing the track section end portions of FIG. 1 in an assembled condition.

FIG. 4 is a sectional view taken generally along the line 4—4 of FIG. 3, and showing in phantom an additional like track section in a nested condition for storage or transit.

DESCRIPTION OF THE PREFERRED EMBODIMENTS

Figure 1:
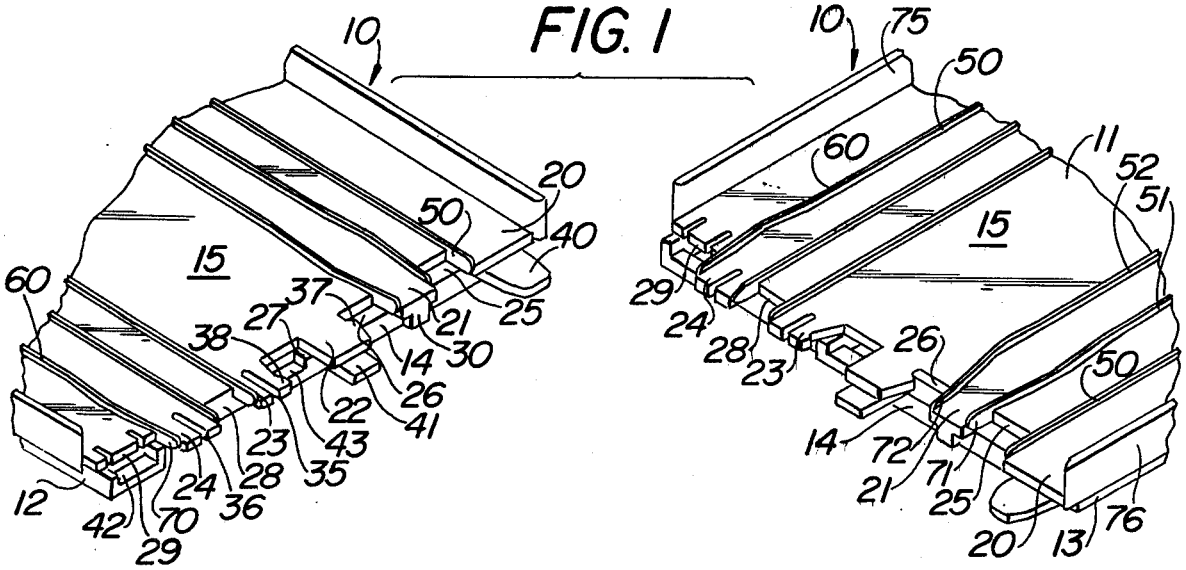
FIG. 1 is a top perspective view showing end portions of like track sections adapted for assembly and disassembly in accordance with the teachings of the present invention.
Figure 2:
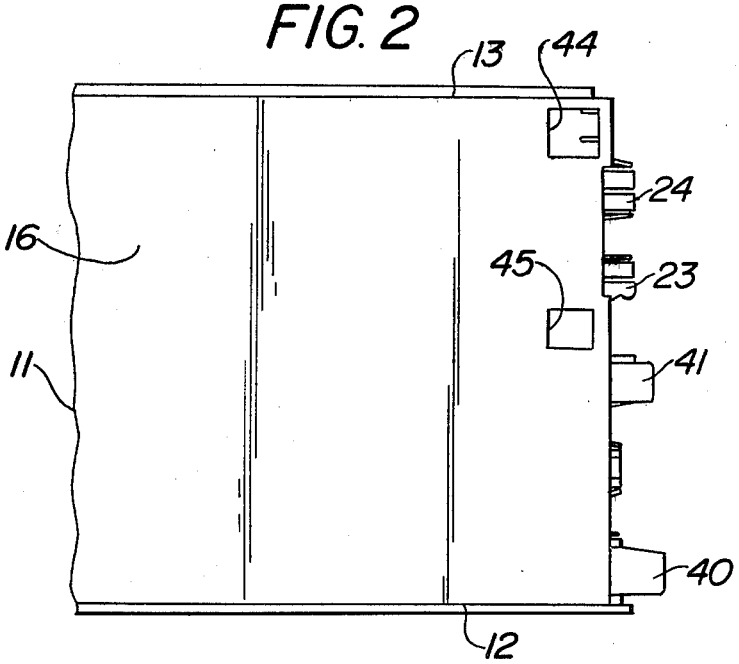
FIG. 2 is a bottom plan view of one of the track section end portions of FIG. 1.

Referring now to FIGS. 1 and 2, a pair of like track sections are each generally designated 10 in FIG. 1, and may each include a generally flat base plate or bed 11. While the track sections 10 of the illustrated embodiment are shown as straight, it is appreciated that suitably nonstraight or curved track sections may be constructed in accordance with the teachings of the present invention. The bed 11 of each track section 10 includes a pair of parallel spaced longitudinally extending side edges 12 and 13, and a pair of opposite end edges 14, each extending generally normal to and between the adjacent pair of ends of side edges 12 and 13. The bed 11 may further include a generally flat upper surface 15 extending between the side edges 12 and 13, and end edges 14. Also, the lower or under surface 16 of bed 11 may be generally flat, and similarly extend between the side and end edges 12, 13 and 14.

Each end edge 14 is formed with a plurality of laterally spaced longitudinally extending projections, as at 20, 21, 22, 23 and 24. The end projections 20–24 are all substantially flush with the upper bed surface 15, and above or spaced from the lower or under bed surface 16. The projection 20 may have one side generally flush with the adjacent bed side edge 13, and is spaced from the next adjacent end projection 21 by an intermediate recess 25. The projection 22 is similarly spaced laterally from the projection 21 by a recess 26 between the projections 21 and 22, and similarly a recess 27 is defined by the space between next adjacent end projection 23 and end projection 22. The end projection 24 is similarly spaced from the projection 23 by an intermediate recess 28, while the space between projection 24 and adjacent side edge 12 may be considered as a recess, as at 29. The recesses 25, 26, 27, 28 and 29 serve to respectively receive projections 24, 23, 22, 21 and 20, upon end to end aligned digitally interfitting engagement, as in the condition showin in FIG. 3.

As the recesses 25, 26, 27, 28 and 29 all may be considered as opening upwardly through surface 15, the projections 24, 23, 22, 21 and 20 are respectively received therein in flush relation therewith, as being flush with the upper surface 15. Also, the end projections 20–24 are all spaced above the bed underside 16, except for a lower reinforcing portion 30 of projection 21. In conforming relation therewith, the recess 28 may open downwardly through the under surface 16 for receiving the lower portion 30 of a mating projection 21.

Certain of the projections may be provided with enhanced resilience, as by slits or cuts 35 and 36 in projections 23 and 24. That is, the cuts or slits 35 and 36 extend longitudinally inwardly into the projecting ends of projections 23 and 24, to subdivide or bifurcate the projections and define resilient tines of the projections. Also, one or more snap engagement formations or detents may be provided on certain end projections, as at 37 on projection 22, and 38 on projection 23. The detent 38 is, by the resilient nature of projection 23, resiliently deflectable for snap engagement beyond a mating detent 37 of a like track section in the interfitting track relation.

Each end edge 14 of a track section 10 is further provided with a plurality of laterally spaced additional projections, as at 40 and 41. The projections 40 and 41 are spaced below the upper bed surface 15, and may also be spaced above the lower bed surface 16. Further, the projections 40 and 41 project from and longitudinally outwardly beyond the ends of respective projections 20 and 22.

Each track section end edge 14 is further provided with a pair of additional openings, receivers or recesses for respective receiving relation with the additional projections 40 and 41 of a like track section. More particularly, each track end edge 14 is provided with a pair of laterally spaced end openings or recesses 42 and 43, which recesses are spaced below the upper bed surface 15, and spaced above the lower bed surface 16 and configured to conformably receive additional projections 40 and 41, respectively. The additional recesses or receivers 42 and 43 are provided with suitable relief openings, as at 44 and 45, say through the under surface 16, see FIG. 2.

Provided in the upper or working surface 15 of each track section 10 are a plurality of longitudinally extending, upwardly facing slots or grooves, being six (6) in number in the illustrated embodiment, and arranged in two groups of three grooves each. The outermost groove of each group is designated 50, the next adjacent or intermediate groove of each group being designated 51, and the inner groove of each group being designated 52.

The six grooves all extend longitudinally of the track section 10, in laterally spaced relation with respect to each other, and each groove opens at its opposite ends into longitudinally oppositely disposed end recesses of the bed 11. Thus, each groove 50 opens at its opposite ends into recesses 25 and 29, each groove 51 opening at its opposite ends into respective recesses 25 and 28, and each groove 52 opening at its opposite ends into longitudinally opposed recesses 26 and 28. More specifically, the grooves 50–52 have their opposite ends opening into the associated recesses, each substantially flush with the adjacent projection. The opposite ends of each groove 50 open substantially flush with respective adjacent projections 20 and 24, the opposite ends of each groove 51 opening substantially flush with respective adjacent projections 21 and 24, and each groove 52 having its opposite ends opening substantially flush with respective adjacent projections 23 and 21.

While the grooves 50–52 extend longitudinally of the track section 10, they are not quite straight, each being provided with a slightly bowed region adjacent to one end of the respective groove. Further, each bowed grooved end region is bowed laterally in the direction away from its adjacent end projection. In particular, each groove 50 is provided adjacent its end projection 24 with a bowed or curved region 55 bowed laterally in the opposite lateral direction away from associated projection 24. The grooves 51 each have the end region adjacent to respective recess 25 and projection 21 bowed outwardly, as at 56 away from the adjacent projection 21. The remaining grooves 52 each have their end region adjacent to projection 21 and recess 26 bowed outwardly, as at 57, away from the adjacent projection 21.

Received in each of the grooves 50–52 is a conductive strip or rail 60–62, which is of resilient character and resiliently deflected along the associated bowed region 55–57, without permanent deformation of the strip. That is, the conductive strips 60–62 may be substantially straight in their "at rest" or undeflected condition apart from the bed 11, and are resiliently deflectable for engagement in the respective receiving grooves 50–52 for passing along the bowed regions 55–57. However, the curvature of the bowed regions is not sufficiently great to require deflection of the received strips sufficient to cause permanent deformation. Thus, the resilient deflection of the received strips serves to frictionally retain the strips in their respective receiving grooves.

In addition, the conductive strips or rails 60–62 have their opposite end portions extending through and out of opposite open ends of the respective receiving grooves 50–52 into the adjacent end recesses. Further, by reason of the conforming curvature of strips 60–62 in the bowed groove regions 55–57, the end portions of the strips beyond the grooves extend obliquely toward the adjacent projections.

Thus, each strip 60–62, when assembled with its bed 11 in a respective receiving groove 50–52 is resiliently deflected in the bowed groove region 55–57 into a bowed strip region 65–67. The strip end portions 70, 71 and 72, extending respectively from bowed strip portions 65, 66 and 67, and being continuations of the bowed regions, extend obliquely toward their respective adjacent end projections 24 and 21. Thus, the strip end portions extending beyond the receiving grooves into an end recess are outwardly divergent or not convergent, while the strip end portions on opposite sides of each projection are outwardly convergent or not divergent, all of which insures proper interfitting relation upon end to end aligned movement toward each other of a pair of like track sections, with effective wiping action between contacting conductive strip end portions.

The track section bed 11 is further provided along opposite side edges 12 and 13 with a pair of longitudinally extending side walls, curbs or barriers 75 and 76. The side walls or barriers are generally longitudinally coextensive with the track section, so as to be continuous with the side walls or barriers of an end to end connected like track section. While the side walls or barriers 75 and 76 upstand beyond the upper or working surface 15 of the bed 11, they are cut away or provided with a downwardly facing shoulder, as at 77 and 78, spaced above the lower or supporting surface 16 of the bed. By this advantageous construction, an additional like track section, showing in phantom in FIG. 4, may be arranged in a closely nested, superposed relation with the track section shown in solid lines. Of course, a multiplicity of like track sections may also be arranged in nested relation to achieve substantial space savings in transit and shipment.

From the foregoing, it is seen that the present invention provides a substantially improved track construction for use with model vehicles which is extremely simple in structure, easy to assemble and disassemble even for small children, achieves substantial economies in manufacture, and is durable and reliable throughout a long useful life.

Although the present invention has been described in some detail by way of illustration and example for purposes of clarity of understanding, it is understood that certain changes and modifications may be made within the spirit of the invention.

What is claimed is:

1. A track section for model vehicles, said track section comprising a generally flat bed having an upper working surface bounded within a pair of spaced side edges, a plurality of spaced projections on each end edge, said projections combining to define recesses in the spaces between said projections, said projections and recesses being configured for interdigitation upon end to end aligned engagement with a like track section, said working surface being formed with upwardly facing slots having their opposite ends opening into said recesses adjacent to said projections, conductive strips located in said slots and having end portions extending through the open slot ends into said recesses along the adjacent sides of said projections for wiping engagement of said strip end portions with the strip end portions of a like track section on said end to end aligned engagement, and an upstanding wall on each side edge of said bed and having its lower edge spaced above the underside of said bed to define a recess between the lower edge of each upstanding wall and the adjacent side edge of said bed, each of said recesses having a cross-sectional configuration substantially identical to the cross-sectional configuration of a respective upstanding wall above said working surface, for nesting superposed engagement with a like track section with the upstanding walls of the lower section conformably entering said recesses of the upper section for maximum economy of space in storage, said conductive strips being resilient and substantially straight in undeflected condition, and said slots being of a nonstraight configuration to receive said strips in a resiliently deflected condition without permanent strip deformation, said resilient strip deflection serving to frictionally retain said strips in said slots.

2. A track section for model vehicles, said track section comprising a generally flat bed having an upper working surface bounded within a pair of spaced side edges, a plurality of spaced projections on each end edge, said projections combining to define recesses in the spaces between said projections, said projections and recesses being configured for interdigitation upon end to end aligned engagement with a like track section, said working surface being formed with upwardly facing slots having their opposite ends opening into said recesses adjacent to said projections, conductive strips located in said slots and having end portions extending through the open slot ends into said recesses along the adjacent sides of said projections for wiping engagement of said strip end portions with the strip end portions of a like track section on said end to end aligned aligned engagement, and an upstanding wall on each side edge of said bed and having its lower edge spaced above the underside of said bed to define a recess between the lower edge of each upstanding wall and the adjacent side edge of said bed, each of said recesses having a cross-sectional configuration substantially identical to the cross-sectional configuration of a respective upstanding wall above said working surface, for nesting superposed engagement with a like track section with the upstanding walls of the lower section conformably entering said recesses of the upper section for maximum economy of space in storage, certain of said slots being configured to resiliently deflect an end portion of the received strip obliquely toward the adjacent projection without permanent deformation of the received strip, to facilitate entry of strip end portions on opposite sides of a projection between strip end portions on opposite sides of a receiving recess.

* * * * *